US007023401B2

(12) United States Patent
Thrash et al.

(10) Patent No.: US 7,023,401 B2
(45) Date of Patent: Apr. 4, 2006

(54) ANTENNA REFLECTOR WITH LATCH SYSTEM AND ASSOCIATED METHOD

(75) Inventors: Keith Edward Thrash, Kilgore, TX (US); Michael Dyer, Longview, TX (US); Jeremy Bartell, Longview, TX (US)

(73) Assignee: Vertexrsi, TX (US)

( * ) Notice: Subject to any disclaimer, the term of this patent is extended or adjusted under 35 U.S.C. 154(b) by 46 days.

(21) Appl. No.: 10/887,726

(22) Filed: Jul. 9, 2004

(65) Prior Publication Data

US 2006/0007050 A1 Jan. 12, 2006

(51) Int. Cl.
*H01Q 15/20* (2006.01)

(52) U.S. Cl. ..... 343/915; 343/912

(58) Field of Classification Search ..... 343/915
See application file for complete search history.

(56) References Cited

U.S. PATENT DOCUMENTS 3,397,399 A * 8/1968 Carman et al. ..... 343/915
3,715,760 A * 2/1973 Palmer ..... 343/915
3,835,354 A 9/1974 Torres-Pena
4,458,251 A 7/1984 Bondon
4,506,271 A 3/1985 Gonzalez
4,529,277 A 7/1985 Gee et al.
4,654,671 A 3/1987 Baghdasarian
4,678,091 A 7/1987 Konstant et al.
4,893,132 A * 1/1990 Habibi ..... 343/912
4,994,816 A 2/1991 Kondo
5,020,678 A 6/1991 Klein
5,191,350 A 3/1993 Hemmie
5,230,137 A 7/1993 Abe
5,255,006 A * 10/1993 Pappas et al. ..... 343/915
5,257,034 A * 10/1993 Turner et al. ..... 343/915
5,730,266 A 3/1998 Kajitani et al.
6,624,796 B1 * 9/2003 Talley et al. ..... 343/915

* cited by examiner

*Primary Examiner*—Trinh Vo Dinh
*Assistant Examiner*—Binh Van Ho
(74) *Attorney, Agent, or Firm*—Hunton & Williams LLP

(57) ABSTRACT

An antenna reflector and an associated latch system are provided. The antenna reflector includes a plurality of reflector portions that are connected in a predetermined configuration to define a continuous surface, such as a parabolic surface. The latches connect the reflector portions. Each latch includes first and second latch members, which define reference surfaces that are structured to contact when the latch is closed. In particular, the reference surfaces are disposed at predetermined and dissimilar distances from connection features of the respective latch members. For example, the first and second reference surfaces of the respective latch members can be disposed at first and second distances from apertures through the respective latch members. The first distance can be greater than the second distance so that, when a fastener is disposed through both apertures, the reference surfaces are urged together and the reflector portions are connected in a predetermined configuration. An associated method for connecting a plurality antenna reflector portions in a predetermined configuration is also provided.

23 Claims, 6 Drawing Sheets

ANTENNA REFLECTOR WITH LATCH SYSTEM AND ASSOCIATED METHOD

BACKGROUND OF THE INVENTION

1) Field of the Invention

The present invention relates to the assembly of an antenna reflector and, more particularly, relates to the use of latches for connecting portions of an antenna reflector in a predetermined configuration.

2) Description of Related Art

One conventional communication antenna includes a concave antenna reflector that is configured to reflect radio signals to and/or from a transducer. The antenna reflector typically has a parabolic shape, and the transducer is a receiver or transceiver that is supported at a focal point of the reflector. Thus, the transducer can receive signals reflected by the reflector and/or transmit signals in a particular direction via the reflector.

In some cases, such communication antennas are collapsible so that the antenna can be more easily transported or stored. For example, an antenna reflector with a 2.4 meter diameter can be disassembled into a number of segments or petal-shaped portions. The portions of this so-called "fly-away" antenna can be small enough that, when disassembled, each portion can be accommodated in a standard luggage container for checking on a commercial airline aircraft. In some cases, the antenna reflector can be formed of a lightweight material, such as carbon fiber or another composite material, and the antenna can be assembled and disassembled without tools. Thus, the antenna can be easily disassembled, transported, and reassembled for use in different locations.

The portions of an antenna reflector are typically connected using latches that connect each portion to the adjacent portions. For example, the antenna might have one central portion with a number of peripheral portions arranged around the central portion and connected to the central portion. The central portion can be latched to each of the peripheral portions, and each of the peripheral portions can be latched to its respective adjacent peripheral portions. However, if the antenna reflector is not assembled in the proper configuration, the performance of the antenna will suffer. That is, if the portions of the antenna reflector are not accurately aligned in a predetermined configuration when latched together, the concave reflective surface of the reflector will not be parabolic, and a reduced amount of energy will reflected to or from the transducer. In fact, the misalignment of a conventional latch can disadvantageously affect the shape of an antenna reflector secured thereby and, hence, the performance of the antenna.

Thus, there exists a need for an antenna reflector, a latch for an antenna reflector, and a method for assembling a plurality of reflector portions. The latch should be capable of accurately positioning and securing the multiple portions of the reflector in a predetermined configuration so that the reflector defines a desired shape.

BRIEF SUMMARY OF THE INVENTION

The present invention provides an antenna reflector, a latch system for an antenna reflector, and an associated method for connecting portions of a reflector. The antenna reflector includes a plurality of reflector portions that are connected in a predetermined configuration to define a continuous surface, such as a parabolic or elliptic surface. In particular, the reflector portions are connected by latches, each of which includes first and second latch members. That is, a latch connecting two adjacent reflector portions includes a first latch member that is connected to the first reflector portion and a second latch member that is connected to the second reflector portion.

Each latch member defines a reference surface and a connection feature at a predetermined distance from the reference surface. The reference surfaces are configured to contact when the latch members are connected with the reflector portions in the predetermined configuration. Further, the distances between the reference surfaces and the connection features are dissimilar for the two latch members. For example, the connection feature of each latch member can be an aperture that is configured to receive a fastener such as a bolt. The reference surface of the first latch member can be positioned further from the aperture in the first latch member than the distance between the reference surface and aperture of the second latch member. Thus, when the fastener is disposed in the apertures, the reference surface of the first latch member is urged against the reference surface of the second latch member, thereby ensuring that the reflector portions are disposed in the predetermined configuration. Accordingly, the reflector portions can be disassembled and then accurately assembled to the predetermined configuration.

BRIEF DESCRIPTION OF THE SEVERAL VIEWS OF THE DRAWINGS

Figure 1:
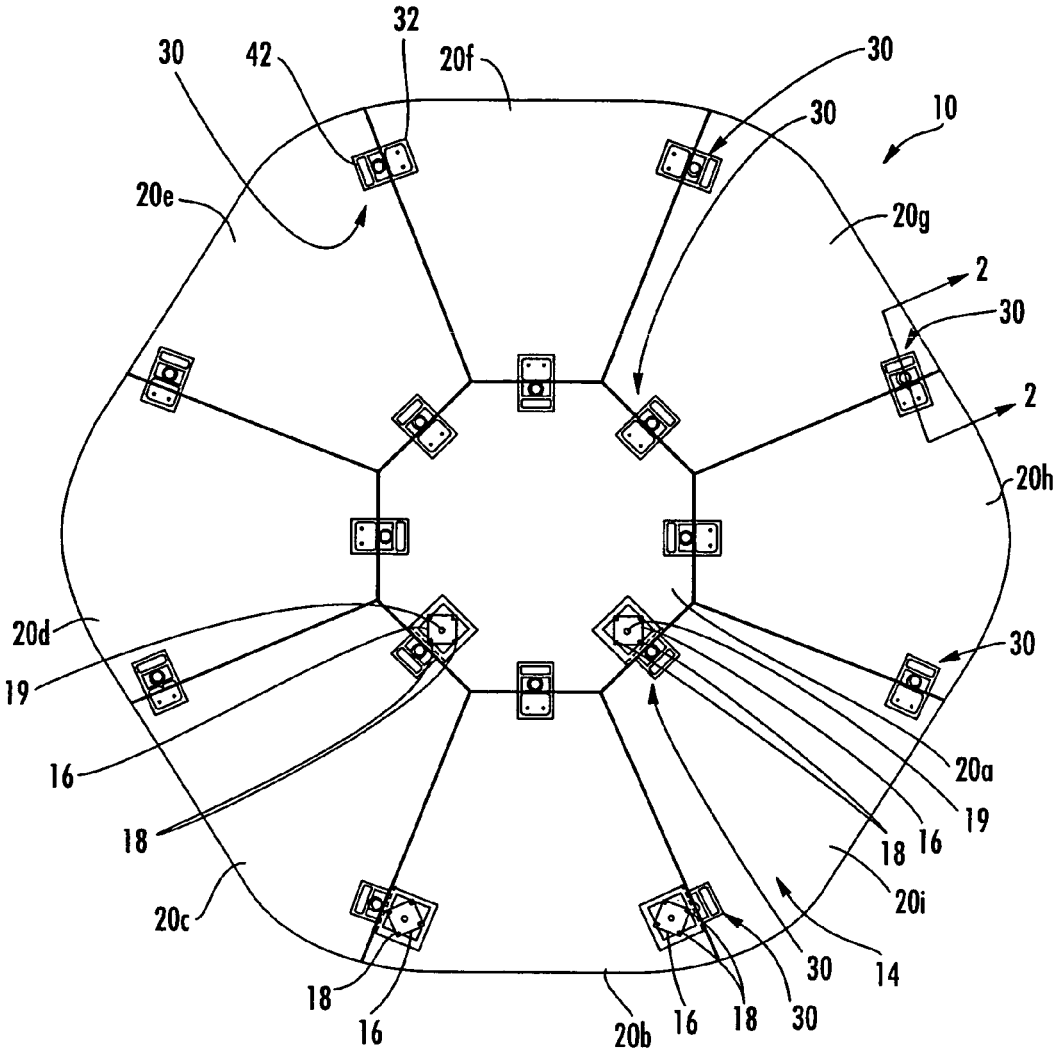
Figure 2:
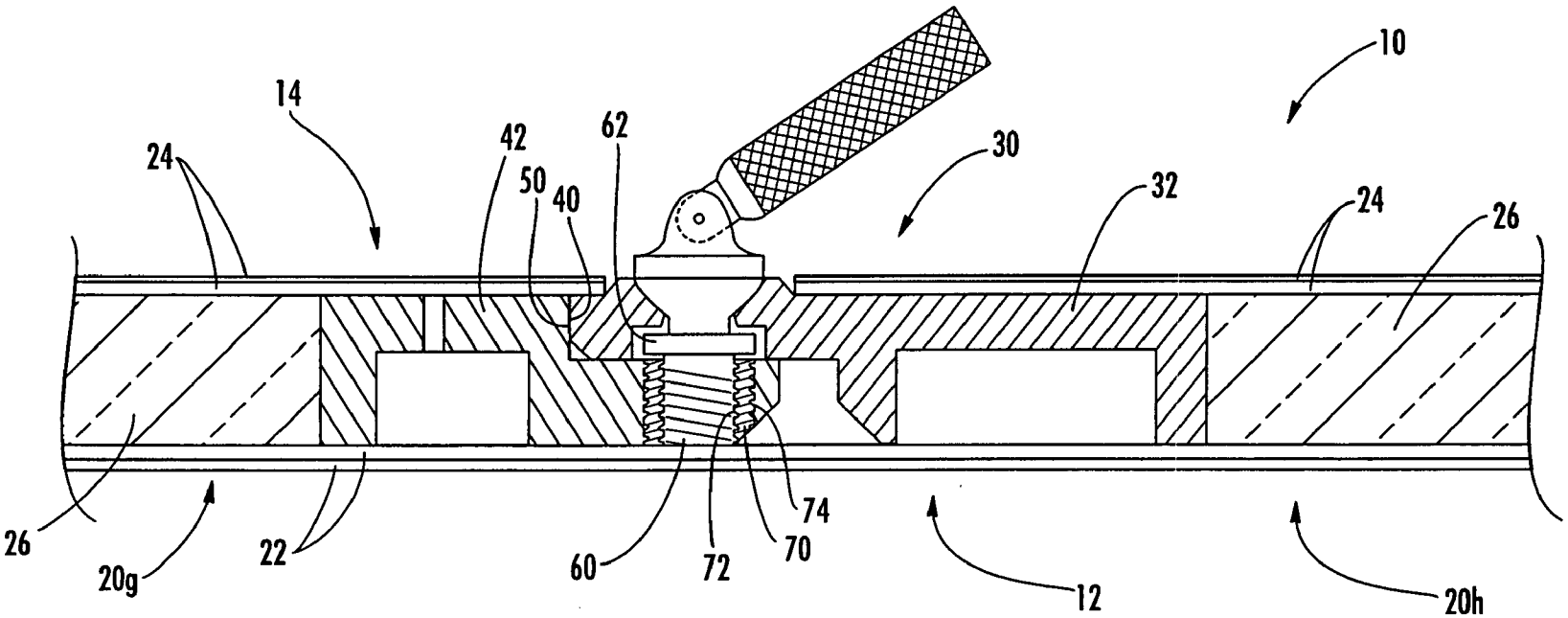
Figure 3:
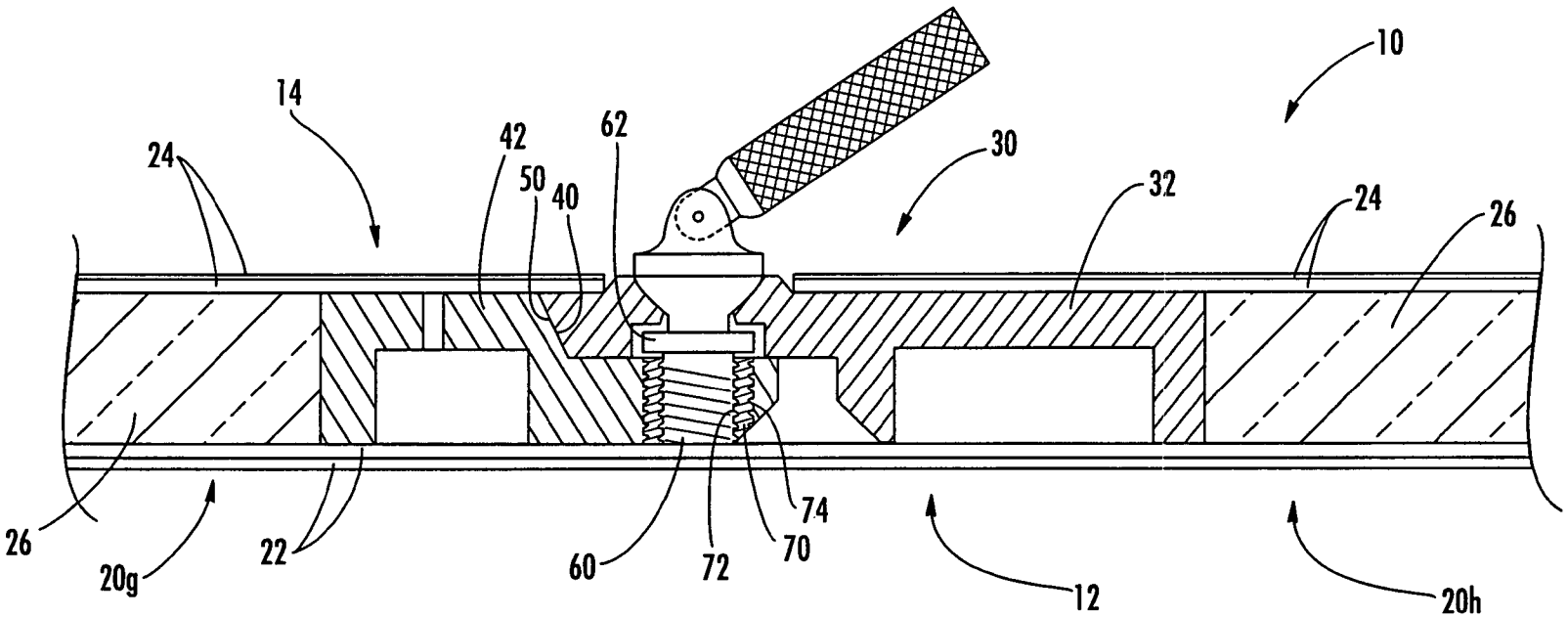
Figure 4:
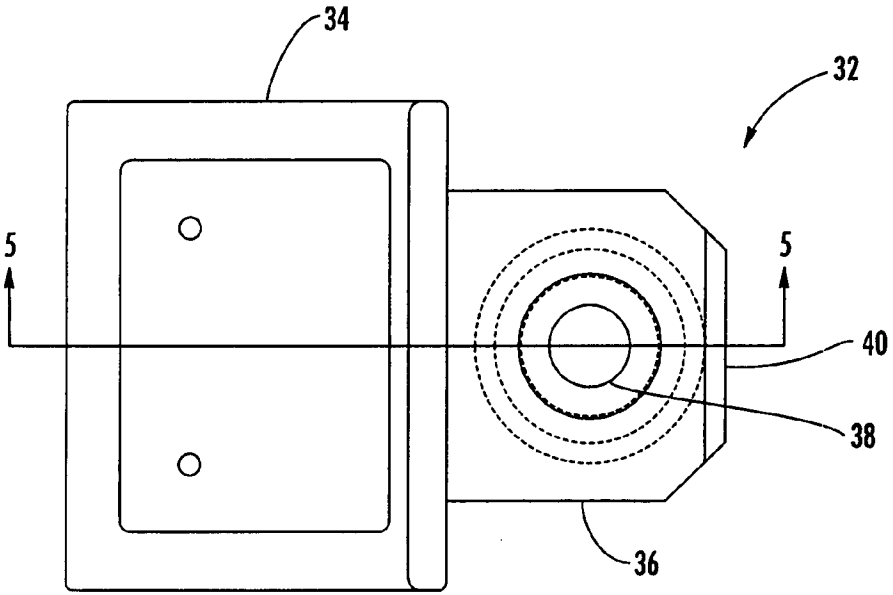
Figure 5:
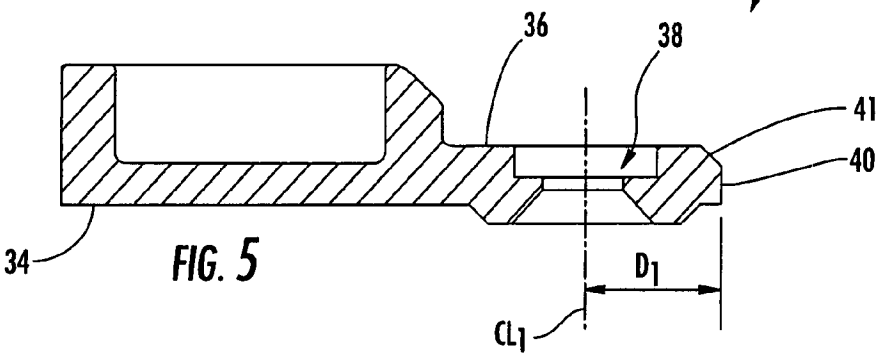
Figure 8:
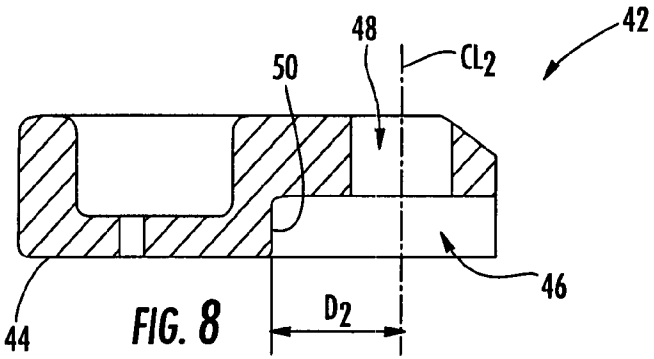
Figure 7:
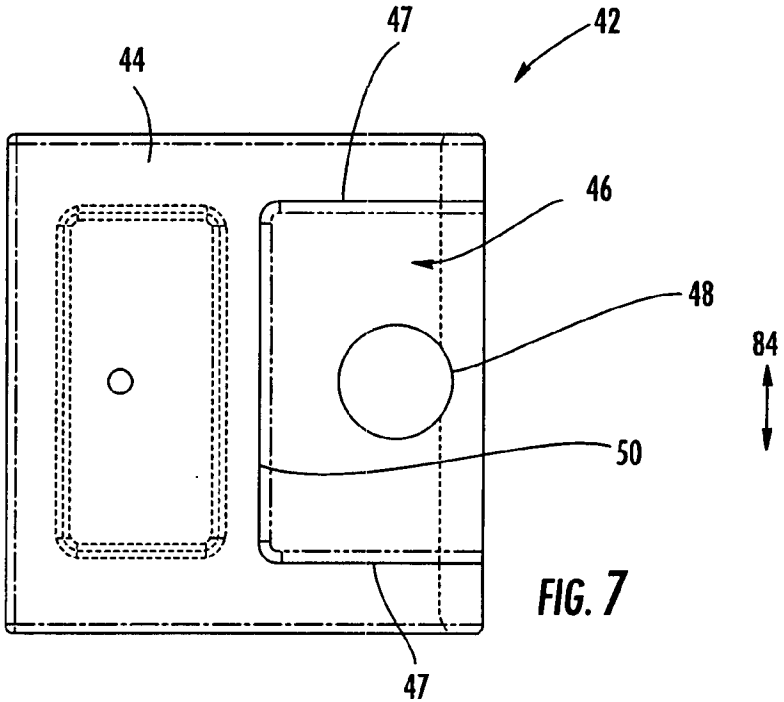
Figure 6:
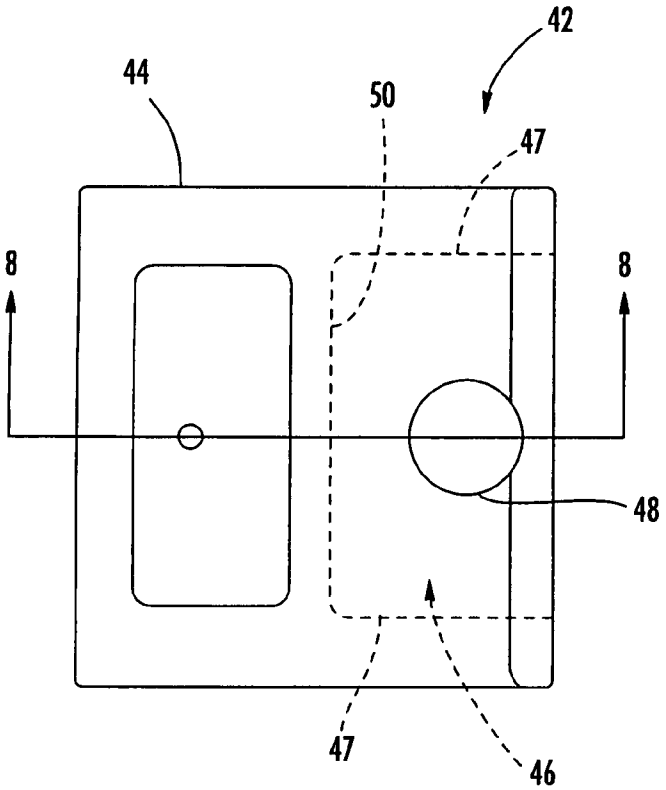
Figure 9:
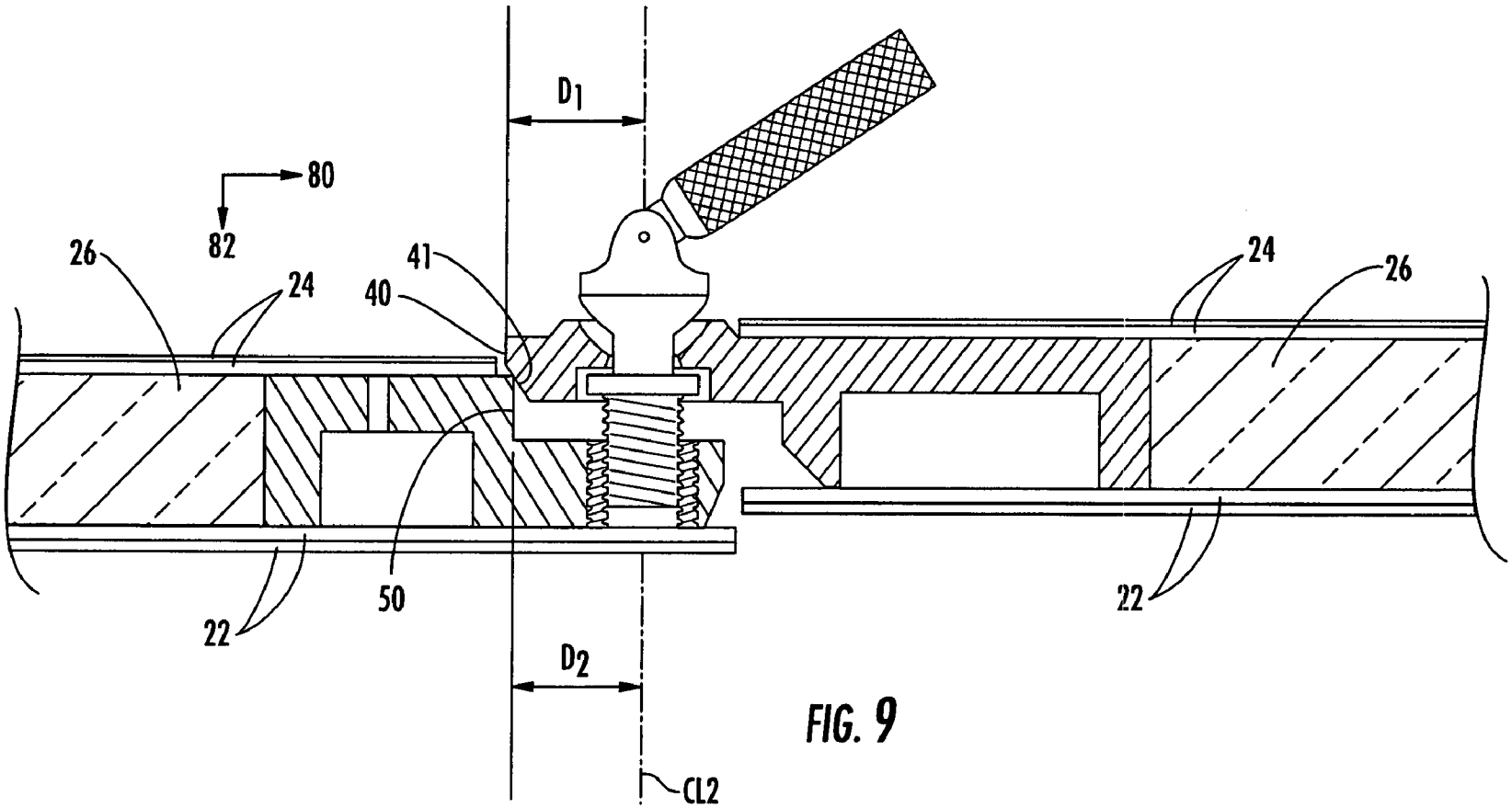

Having thus described the invention in general terms, reference will now be made to the accompanying drawings, which are not necessarily drawn to scale, and wherein:

FIG. 1 is plan view illustrating an antenna reflector including nine assembled reflector portions according to one embodiment of the present invention;

FIG. 2 is a partial section view illustrating the antenna reflector of FIG. 1 as seen along line 2—2 of FIG. 1;

FIG. 3 is a partial section view illustrating an antenna reflector according to another embodiment of the present invention in which the latch members connecting the reflector portions define reference surfaces disposed at a converging angle relative to apertures in the latch members that receive a fastener;

FIG. 4 is a plan view illustrating a first latch member according to one embodiment of the present invention;

FIG. 5 is a section view illustrating the first latch member of FIG. 4 as seen along line 5—5 of FIG. 4;

FIG. 6 is a bottom view illustrating a second latch member for connecting to the first latch member of FIG. 4;

FIG. 7 is a plan view illustrating the second latch member of FIG. 6;

FIG. 8 is a section view illustrating the second latch member of FIG. 6 as seen along line 8—8 of FIG. 6; and FIG. 9 is a section view illustrating the first and second latch members in a partially assembled configuration.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the figures and in particular to FIGS. 1–3, there is shown an assembled antenna reflector 10 according to one embodiment of the present invention. The antenna reflector 10 can be used to reflect electromagnetic signals such as radio frequency energy that is typically used for communication. In this regard, the antenna reflector 10 defines a reflective surface 12, which is typically contoured to define a dished or concave shape. For example, the reflective surface 12 can be parabolic and configured to reflect to and/or from a transceiver (not shown) of the antenna that is positioned at the focal point of the reflector 10. The reflective surface 12 is opposite a back surface 14 of the antenna reflector 10 shown in FIG. 1. The reflector 10 can alternatively be used in other applications, such as for reflecting other types of energy to or from other devices.

The antenna reflector 10 can include any number of assembled portions 20*a*–20*i*, and the portions 20*a*–20*i* can be structured for assembly in a variety of configurations. For example, as illustrated in FIG. 1, the antenna reflector 10 includes nine (9) reflector portions 20*a*–20*i*, i.e., a central portion 20*a* and eight (8) peripheral reflector portions 20*b*–20*i* arranged around the central portion 20*a*. Latches 30 are provided to connect each of the reflector portions 20*a*–20*i* to the adjacent reflector portions 20*a*–20*i*. The latches 30 are configured to be engaged so that the reflector portions 20*a*–20*i* are positioned and secured in a predetermined configuration, e.g., so that the reflective surface 12 of the antenna reflector 10 defines a predetermined contour such as a parabola. Any number of the latches 30 can be provided for connecting the reflective portions 20*a*–20*i* to one another. In addition, as shown in FIG. 1, some of the latches 30 can include a connection portion, such as a flange 16 for connecting the antenna reflector 10 to a stand, base, or other support structure. Each flange 16 can include holes 18 for receiving a fastener that connects the flange to the respective latch 30, as well as at least one hole 19 for receiving a fastener that connects the flange 16 to the support structure.

Each latch 30 includes first and second latch members 32, 42. The first and second latch members 32, 42, according to one embodiment of the present invention, are illustrated in FIGS. 4–5 and 6–8, respectively. The first latch member 32 defines a body portion 34, which can be fixedly attached to one of the reflector portions 20*a*–20*i*, and a flange 36 that extends from the body portion 34 for connecting to one of the second latch members 42. The flange 36 of the first latch member 32 defines an aperture 38 extending therethrough. Similarly, as shown in FIGS. 6–8, the second latch member 42 defines a body portion 44 that can be fixedly attached to one of the reflector portions 20*a*–20*i* adjacent the first latch member 32. The body portion 44 defines a pocket 46 for receiving the flange 36 of the first portion 32. An aperture 48 extends through the second latch member 42 proximate to the pocket 46, at a position that corresponds to the aperture 38 of the first latch member 32. Thus, when the flange 36 is disposed in the pocket 46, a fastener 60 (FIG. 2), such as a bolt, can be inserted through the apertures 38, 48 to secure the first and second latch members 32, 43 and, hence, two of the respective reflector portions 20*a*–20*i* in a desired configuration.

The latch members 32, 42 define corresponding reference surfaces that are configured to contact when the respective reflector portions 20*a*–20*i* are in the desired configuration. In particular, the flange 36 of the first latch member 32 defines a first reference surface 40, and the second latch member 42 defines a second reference surface 50 that partially defines the pocket 46. As illustrated, each of the reference surfaces 40, 50 is substantially parallel to the longitudinal direction of the apertures 38, 48 and, hence, substantially parallel to the direction of the fastener 60 disposed through the apertures 38, 48. In this regard, FIG. 2 illustrates the latch members 32, 42 in a connected configuration, i.e., the flange 36 of the first latch member 32 is disposed in the pocket 46 of the second latch member 42, and the fastener 60 is disposed through the apertures 38, 48 to connect the latch members 32, 42.

In other embodiments, the aperture 38, 48 and reference surfaces 40, 50 of the respective latch member 32, 42 can be disposed at angles, i.e., such that the apertures and references surfaces are non-parallel. The aperture 38, 48 and reference surface 40, 50 of each latch member 32, 42 are typically non-perpendicular to one another. For example, as illustrated in FIG. 3, each of the reference surfaces 40, 50 can be disposed at a converging angle relative to the apertures 38, 48. Typically, the reference surfaces 40, 50 of the latch members 32, 42 are disposed at corresponding angles, i.e., the angle between the first aperture 38 and the first reference surface 40 is substantially the same as the angle between the second aperture 48 and the second reference surface 50, though other configurations are possible.

Either or both of the latch members 32, 42 can be adapted to engage the fastener 60 disposed through the apertures 38, 48. For example, if the fastener 60 is a bolt, one or both of the apertures 38, 48 can be threaded to engage threads on the outer surface of the fastener 60. In one embodiment, the fastener 60 is rotatably retained in one of the apertures 38, 48 and configured to engage the aperture 38, 48 of the other latch member 32, 42. For example, as shown in FIG. 2, a retaining ring 62 can be provided on the fastener 60 to retain the fastener 60 in the aperture 38 of the first latch member 32 even when the latch members 32, 42 are disconnected. The aperture 38 in the first latch member 32 can be configured so that the fastener 60 can rotate freely therein. In other embodiments, the fastener 60 can alternatively be retained by a spring, lanyard, snap-ring, or the like. In any case, the aperture 48 of the second latch member 42 can be threaded so that the fastener 60 engages the aperture 48. In particular, a sleeve 70 can be disposed in the aperture 48 of the second latch member 42, and the sleeve 70 can define threads 72 for engaging the fastener 60. The sleeve 70 can also define threads 74 on its outer surface for engaging corresponding threads of the aperture 48. Alternatively, the sleeve 70 can be otherwise connected to the body portion 44 of the second latch member 42, or the body portion 44 can be configured to engage the fastener 60 directly without the use of the sleeve 70. Further, in other embodiments of the present invention, the fastener 60 can be threadably engaged or otherwise non-rotatably connected to the first latch member 32 instead of, or in addition to, the second latch member 42. Also, if a fastener other than a bolt is used to connect the latch members 32, 42, the latch member(s) 32, 42 can be otherwise structured for engaging the fastener 60.

While the apertures 38, 48 in the latch members 32, 42 are positioned in a generally corresponding configuration relative to the respective reference surfaces 40, 50, the apertures 38, 48 are located at dissimilar distances from the reference surfaces 40, 50. More particularly, as shown in FIGS. 5 and 8, a longitudinal axis, or centerline $CL_1$, of the first aperture 38 in the first latch member 32 is positioned a first distance $D_1$ from the first reference surface 40, and a centerline $CL_2$ of the second aperture 48 in the second latch member 42 is positioned a second distance $D_2$ from the second reference surface 50. As illustrated in FIG. 9, the first distance $D_1$ can be greater than the second distance $D_2$. That is, in order to align the centerlines $CL_1$, $CL_2$ of the apertures 38, 48, the reference surfaces 40, 50 are urged together and one or both of the latch members 32, 42, the fastener 60, and/or the sleeve 70 are at least slightly compressed. The difference between the first and second distances $D_1$, $D_2$ can be relatively small, e.g., between about 0.020 inch and 0.040, inch such as about 0.030 in one embodiment.

It is appreciated that, by virtue of the dissimilar distances $D_1$, $D_2$ defined between the apertures 38, 48 and the respective reference surfaces 40, 50, the reference surfaces 40, 50 are pressed together when the fastener 60 is disposed through the apertures 38, 48. The latch members 32, 42 are secured to the respective reflector portions 20*a*–20*i* so that the reflector portions 20*a*–20*i* are disposed in a desired configuration when the reference surfaces 40, 50 contact. Thus, the desired configuration of the reflector portions 20*a*–20*i* can be achieved and maintained by connecting the latch members 32, 42. In fact, in some embodiments, the connection of the latches 30 can ensure alignment of each of the adjacent reflector portions 20*a*–20*i* in three axes: the first latch member 32 can be urged into contact with the reference surface 50 to align two of the reflector portions 20*a*–20*i* in a first direction 80 (FIG. 9); as the fastener 60 is tightened, the first latch member 32 is urged against the second latch member 42, thereby relatively configuring the two reflector portions 20*a*–20*i* in a second direction 82 (FIG. 9); and the pocket 46 of the second member 42 can define transverse sides 47 that retaining the flange 36 at least to some degree in a third direction 84 (FIG. 7).

The fastener 60 can define a frustoconical head that corresponds to a frustoconical portion of the aperture 38 in the first latch member 32 so that, as the fastener 60 is inserted through the apertures 38, 48, the first and second latch members 32, 42 are adjusted to the desired configuration, i.e., with the apertures 38, 48 collinear. Further, one or both of the latch members 32, 42 can define a tapered or wedge shaped surface for sliding against the opposite latch member as the latch 30 is connected. For example, as shown in FIG. 9, the first latch member 32 has a tapered surface 41 adjacent the reference surface 40 that is disposed at an angle to the reference surface 40. The tapered surface 41 is configured to receive the reference surface 50 of the second latch member 42 in sliding contact as the flange 36 of the first latch member 32 is disposed in the pocket 46 of the second latch member 42.

The fastener 60 can define a grip portion, such as a handle 64 extending from the latch members 32, 42, so that a person can easily grasp the fastener 60 and secure the latch members 32, 42 without the use of tools. The handle 64 can be hinged so that the handle 64 can be rotated during use or rotated to a stored position against the back 14 of the antenna reflector 10 when not in use. Alternatively, the fastener 60 can define other features that can be engaged using a tool, such as a slotted head for receiving a screwdriver or a hexagonal head for engagement by a wrench.

The reflector portions 20*a*–20*i* are typically formed of lightweight materials. In one embodiment, the reflector portions 20*a*–20*i* are formed of a composite material, i.e., a reinforcement material impregnated with a curable matrix material. The reinforcement material can be fibers or weaves of a variety of materials such as carbon, graphite, fiberglass, or Kevlar, a registered trademark of E.I. du Pont de Nemours and Company. The matrix material can be a thermoset or thermoplastic material, such as a resin or epoxy.

In one typical method of manufacturing composite materials, the reinforcement and matrix materials are disposed in a desired configuration with the matrix material in an uncured state. Then, with the reinforcement material in the desired configuration, the matrix material is cured and hardened, e.g., by application of heat and pressure. The reflector portions 20*a*–20*i* of the antenna reflector 10 can be formed in this manner, and the latch members 32, 42 can be disposed partially within the composite materials so that, upon curing of the matrix material, the latches 30 are rigidly and fixedly connected to the reflector portions 20*a*–20*i*. For example, as illustrated in FIGS. 2 and 3, the reflector portions 20*a*–20*i* can be formed of layers 22, 24 of a composite matrix material with foam panels 26 disposed therebetween. The body portions 34, 44 of the latch members 32, 42 can also be disposed between the layers 22, 24 of the composite matrix material. Alternatively, in other embodiments, the latches 30 can be connected to the respective reflector portions 20*a*–20*i* after the portions 20*a*–20*i* have been formed. For example, the reflector portions 20*a*–20*i* can be formed of composite materials or other materials, and the latches 30 can be glued, bolted, or otherwise affixed to the reflector portions 20*a*–20*i* in the desired configuration after forming the reflector portions 20*a*–20*i*. In any case, the reflector portions 20*a*–20*i* can be formed individually or in combination. For example, the multiple reflector portions 20*a*–20*i* can be cured together while disposed in the desired configuration of the antenna reflector 10. In some cases, the latches 30 can be disposed in the uncured reflector portions 20*a*–20*i*, with each latch 30 in a connected configuration, so that the latches 30 are positioned as desired in the adjacent portions 20*a*–20*i* upon curing of the portions 20*a*–20*i*.

The latch 30 of the present invention can be used to accurately position the reflector portions 20*a*–20*i* during assembly of the antenna reflector 10 and thereafter maintain the position of the reflector portions 20*a*–20*i* so that the antenna reflector 10 defines a continuous surface 12 having the desired configuration. According to one method of the present invention, two portions $\mathbf{20}_g$, $\mathbf{20}_h$ of the antenna reflector 10 are positioned as illustrated in FIG. 9 so that the first latch member 32 connected to the portion $\mathbf{20}_g$ is disposed in the pocket 46 of the second latch member 46 connected to the reflector portion $\mathbf{20}_h$. The fastener 60 is disposed at least partially through the corresponding apertures 38, 48 defined by the latch members 32, 42 in a direction substantially parallel to the first and second reference surfaces 40, 50. For example, if the fastener 60 is a bolt, the fastener 60 can be rotated to urge the first and second latch members 32, 42 together, thereby sliding the surface 41 of the first latch member 32 against the second latch member 42 and urging the first and second reference surfaces 40, 50 together. Each of the reflector portions 20*a*–20*i* of the antenna reflector 10 can be connected in this manner to one or more of the other reflector portions 20*a*–20*i*, so that the entire antenna reflector 10 is assembled in the predetermined configuration.

Many modifications and other embodiments of the invention set forth herein will come to mind to one skilled in the art to which this invention pertains having the benefit of the teachings presented in the foregoing descriptions and the associated drawings. For example, while the latches are described in connection with an antenna reflector for a communication antenna, it is appreciated that the latches can alternatively be used for connecting other devices. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An antenna reflector comprising:

at least two reflector portions configured to be connected to define a continuous surface of the antenna reflector;

at least one latch for connecting adjacent pairs of the reflector portions, each latch comprising:

a first latch member connected to a first portion of a respective pair of reflector portions, the first latch member defining a first reference surface and a first aperture adapted to at least partially receive a fastener, the first aperture being disposed at a first distance from the first reference surface; and a second latch member connected to a second portion of the respective pair of reflector portions, the second latch member defining a pocket for receiving the flange of the first latch member, the pocket defining a second reference surface and the second latch member defining a second aperture adapted to at least partially receive the fastener, the second aperture being disposed at a second distance from the second reference surface, wherein the first distance is greater than the second distance such that the first and second reference surfaces are configured to be urged together by a fastener disposed through the first and second apertures, thereby positioning the adjacent pair of the reflector portions in a predetermined configuration.

2. An antenna reflector according to claim 1 wherein the reflector portions are configured to define the reflector surface in a dish-shaped contour with the reflector portions positioned in the predetermined configuration.

3. An antenna reflector according to claim 1 wherein the antenna reflector comprises at least three of the reflector portions and each reflector portion is configured to be connected to at least two adjacent reflector portions by the latches.

4. An antenna reflector according to claim 1, further comprising a plurality of fasteners, each fastener disposed through the apertures of a respective one of the latches, wherein each fastener is a bolt defining an outer surface with threads for engaging at least one of the latch members of the respective latch.

5. An antenna reflector according to claim 1 wherein at least one of the apertures of the latch members of each latch defines threads for engaging the fastener disposed therein.

6. An antenna reflector according to claim 1 wherein one of the latch members of each respective latch is configured to rotatably retain the fastener therein and the other latch member of the respective latch is configured to engage the fastener.

7. An antenna reflector according to claim 1 wherein the first distance is between about 0.020 inch and 0.040 inch greater than the second distance.

8. An antenna reflector according to claim 1 wherein the reflector portions are formed of a composite material having a reinforcement material disposed in a matrix material, each latch member being disposed at least partially in a respective one of the reflector portions.

9. An antenna reflector according to claim 1 wherein at least one of the latch members defines a tapered surface adjacent the reference surface and disposed at an angle to the reference surface, such that the tapered surface is configured to receive the reference surface of the opposite latch member in sliding contact as the first latch member is disposed in the pocket of the second latch member.

10. An antenna reflector according to claim 1 wherein the first aperture defined by the first latch member is disposed substantially parallel to the first reference surface and the second aperture defined by the second latch member is disposed substantially parallel to the second reference surface.

11. A latch system for connecting first and second portions of an antenna reflector in a predetermined configuration, the latch system comprising:

a first latch member connected to a first portion of the antenna reflector, the first latch member defining a first reference surface and a first aperture adapted to at least partially receive a fastener, the first aperture being disposed at a first distance from the first reference surface; and a second latch member connected to a second portion of the antenna reflector, the second latch member defining a pocket for receiving the flange of the first latch member, the pocket defining a second reference surface and the second latch member defining a second aperture adapted to at least partially receive the fastener, the second aperture being disposed at a second distance from the second reference surface, wherein at least one of the apertures defines threads for engaging a fastener, and the first distance is greater than the second distance such that the first and second reference surfaces are configured to be urged together by the fastener disposed at least partially through the first and second apertures, thereby positioning the first and second portions of the antenna reflector in the predetermined configuration.

12. A latch system according to claim 11, further comprising the fastener, wherein the fastener is a bolt defining an outer surface with threads for threadably engaging at least one of the latch members.

13. A latch system according to claim 11 wherein one of the latch members is configured to rotatably retain the fastener therein and the other latch member of the latch is configured to engage the fastener.

14. A latch system according to claim 11 wherein the first distance is between about 0.020 inch and 0.040 inch greater than the second distance.

15. A latch system according to claim 11 wherein at least one of the latch members defines a tapered surface adjacent the reference surface and disposed at an angle to the reference surface, such that the tapered surface is configured to receive the reference surface of the opposite latch member in sliding contact as the first latch member is disposed in the pocket of the second latch member.

16. A latch system according to claim 11 wherein the first aperture defined by the first latch member is disposed substantially parallel to the first reference surface and the second aperture defined by the second latch member is disposed substantially parallel to the second reference surface.

17. A method for connecting a plurality of portions of an antenna reflector in a predetermined configuration, the method comprising:

positioning first and second portions of the antenna reflector such that a first latch member connected to the first portion is disposed in a pocket defined by a second latch member connected to the second portion; and disposing a fastener at least partially through corresponding apertures defined by the first and second latch members in a direction non-perpendicular to a first reference surface defined by the first latch member and a second reference surface defined by the second latch member, and thereby urging the first and second reference surfaces together such that the adjacent pair of the reflector portions are positioned in a predetermined configuration to define a continuous surface of the antenna reflector.

18. A method according to claim 17, further comprising repeating said positioning and disposing steps to connect at least three portions of the antenna reflector in a predetermined configuration.

19. A method according to claim 17 wherein said disposing step comprises disposing a bolt through the apertures and engaging the bolt to at least one of the latch members.

20. A method according to claim 17 wherein said positioning and disposing steps comprise compressing at least one of the latch members by between about 0.020 inch and 0.040 inch between the aperture and reference surface.

21. A method according to claim 17, further comprising forming the reflector portions of a composite material having a reinforcement material disposed in a matrix material, wherein said forming step comprises disposing each latch member in a respective one of the reflector portions before curing the composite material of the reflector portions.

22. A method according to claim 21, further comprising supporting the latch members in a predetermined configuration while the composite material of the reflector portions is cured such that the reflector portions are disposed in the predetermined configuration when the fastener is disposed in the latch members.

23. A method according to claim 17 wherein said disposing step comprises disposing the fastener through the apertures in a direction substantially parallel to the first and second reference surfaces.

* * * * *